US008235876B2

(12) United States Patent
Reyes

(10) Patent No.: US 8,235,876 B2
(45) Date of Patent: Aug. 7, 2012

(54) ABDOMINAL TRAINING APPARATUS

(75) Inventor: Gil Reyes, Las Vegas, NV (US)

(73) Assignee: GRAA Innovations, LLC, Las Vegas, NV (US)

( * ) Notice: Subject to any disclaimer, the term of this patent is extended or adjusted under 35 U.S.C. 154(b) by 0 days.

(21) Appl. No.: 12/653,512

(22) Filed: Dec. 14, 2009

(65) Prior Publication Data

US 2011/0143890 A1 Jun. 16, 2011

(51) Int. Cl.
*A63B 21/062* (2006.01)
*A63B 23/02* (2006.01)

(52) U.S. Cl. ..... 482/140; 482/102; 482/134; 482/145

(58) Field of Classification Search ..... 482/92–95, 482/97–103, 133, 134, 138–140, 142, 145; D21/676, 687

See application file for complete search history.

(56) References Cited

U.S. PATENT DOCUMENTS

| | | | | | |
|---|---|---|---|---|---|
| 894,052 | A | * | 7/1908 | Radtke | 297/471 |
| 4,257,592 | A | | 3/1981 | Jones | |
| 4,500,089 | A | | 2/1985 | Jones | |
| 4,598,907 | A | * | 7/1986 | Ross | 482/97 |
| 4,600,196 | A | | 7/1986 | Jones | |
| 4,632,388 | A | * | 12/1986 | Schleffendorf | 482/102 |
| 4,635,926 | A | * | 1/1987 | Minkow | 482/102 |
| 4,721,301 | A | | 1/1988 | Drake | |
| 4,725,056 | A | | 2/1988 | Rehrl et al. | |
| 4,836,536 | A | | 6/1989 | Jones | |
| 4,900,018 | A | * | 2/1990 | Ish et al. | 482/138 |
| 4,986,538 | A | * | 1/1991 | Ish, III | 482/138 |
| 5,056,779 | A | | 10/1991 | Webb | |
| 5,094,449 | A | * | 3/1992 | Stearns | 482/130 |
| 5,190,513 | A | | 3/1993 | Habing et al. | |
| 5,242,347 | A | | 9/1993 | Keeton | |
| 5,324,247 | A | * | 6/1994 | Lepley | 482/134 |
| 5,358,462 | A | * | 10/1994 | Calderone | 482/137 |
| 5,632,710 | A | | 5/1997 | England et al. | |
| 5,665,041 | A | | 9/1997 | Hsieh | |

(Continued)

FOREIGN PATENT DOCUMENTS

DE 3632124 A1 * 4/1988

(Continued)

OTHER PUBLICATIONS

Vectra On-Line 1270 brochure, owners manual and parts list, Vectra Fitness, Inc., 1998.*

(Continued)

*Primary Examiner* — Loan Thanh
*Assistant Examiner* — Victor K Hwang
(74) *Attorney, Agent, or Firm* — Jones Day

(57) ABSTRACT

An abdominal training apparatus provides focused training on the abdominal muscles using a resistance provided by a resistance device. The user may be supported in an elevated position by a seat support. A cable may transfer the resistance from the resistance device to the user. One or more pulleys may guide the resistance such to the user such that a force vector below and away from the user is provided to the user. In use, the user may perform abdominal training by engaging or grasping the cable to engage the resistance. The user may also support or secure one or both legs using a leg support of the apparatus. The force vector of the resistance is highly beneficial in that it allows the resistance to target and strengthen the abdominal muscles.

5 Claims, 8 Drawing Sheets

U.S. PATENT DOCUMENTS

| | | | | |
|---|---|---|---|---|
| 5,716,308 | A * | 2/1998 | Lee | 482/130 |
| 5,733,229 | A | 3/1998 | Dalebout et al. | |
| 5,800,321 | A * | 9/1998 | Webber | 482/103 |
| 5,938,575 | A | 8/1999 | Stearns | |
| 6,120,423 | A * | 9/2000 | Mackey et al. | 482/121 |
| 6,394,935 | B1 * | 5/2002 | Lake | 482/94 |
| 6,478,721 | B1 | 11/2002 | Hunter | |
| 6,634,996 | B2 | 10/2003 | Jacobsen | |
| 6,764,429 | B1 | 7/2004 | Michalow | |
| 6,896,643 | B2 | 5/2005 | Durfee, Jr. | |
| 7,083,556 | B1 | 8/2006 | Miskech | |
| 7,601,109 | B2 * | 10/2009 | Roumayah | 482/142 |
| 2006/0217249 | A1 | 9/2006 | Webber | |
| 2008/0090710 | A1 * | 4/2008 | Chung | 482/142 |

FOREIGN PATENT DOCUMENTS

| | | | |
|---|---|---|---|
| DE | 3844233 | A1 * | 7/1990 |
| GB | 2405108 | A * | 2/2005 |
| WO | WO 2004043548 | A1 * | 5/2004 |

OTHER PUBLICATIONS

Schwinn Comp Training System, Owner's Manual & Fitness Guide, Abdominal Exercises p. 36, Schwinn Fitness, The Nautilus Group, 2003.*

* cited by examiner

ABDOMINAL TRAINING APPARATUS

BACKGROUND OF THE INVENTION

1. Field of the Invention

The invention relates to exercise equipment and in particular to an improved abdominal muscle training device and method therefor.

2. Related Art

Various methods and devices have been traditionally used to train the abdominal muscles. For example, crunches or sit ups may be performed to tone and strengthen the abdominal muscles. It is known however, that improper technique with crunches or sit ups reduces their effectiveness and may cause injuries. In addition, even when performed correctly, a great number of crunches or sit ups may be required to obtain the desired strengthening or toning.

As a result, abdominal training is commonly performed with a resistance provided by an exercise machine. These machines typically support a user in a seated position and provide resistance through rigid structures. Though the effectiveness of abdominal training may be increased by the machine, some of the user's effort is wasted due to the machine's configuration.

From the discussion that follows, it will become apparent that the present invention addresses the deficiencies associated with the prior art while providing numerous additional advantages and benefits not contemplated or possible with prior art constructions.

SUMMARY OF THE INVENTION

The abdominal training apparatus provides focused abdominal training through a resistance assembly and support assembly. In one or more embodiments, these assemblies provide a resistance to the user that has a force vector oriented below and away from the user during abdominal training. This is advantageous in that it provides complete training of individual abdominal muscles. As will be described below, this may be accomplished by elevating the user with the support assembly, providing a resistance from below and away from the user, or both.

The abdominal training apparatus may be configured in a variety of ways. In one embodiment the abdominal training apparatus comprises a frame having a front end and a back end, and configured to support one or more elements of the abdominal training apparatus. A leg support configured to support one or more of the user's legs may be at the front end of the frame. A resistance device configured to provide a resistance for abdominal training may be at the back end of the frame. The resistance device may be configured to provide resistance in various ways. For example, the resistance device may be a weight stack having one or more weights.

A cable having a first end attached to the resistance device may also be included. The cable may be used to transfer the resistance from the resistance device to the user at a variety of different force vectors. The cable may have a harness at its second end. The harness may comprise a plurality of shoulder straps configured to be grasped by the user to engage the cable for abdominal training.

The user is typically supported by a seat support of the training apparatus. The seat support may be between the resistance device and the leg support, and may be elevated over the frame by one or more risers. This supports the user at an elevated position during abdominal training. The seat support may comprise a seat and a backrest. It is contemplated that the backrest may be angled towards the seat to support the user in a reclined position.

The apparatus may also include one or more pulleys configured to guide the cable from the resistance device to the user. At least one of the one or more pulleys may be located below the seat support to provide a force vector that is below and away from the user during abdominal training. The pulleys may be positioned in various ways. For example, a first pulley and a second pulley of the one or more pulleys may be below the seat support with the second pulley being lower and further away from the first pulley. In this manner, use of the first pulley provides the resistance to the user at a first force vector below and away from the user, while use of the second pulley provides the resistance to the user at a second force vector below and away from the user, the first force vector and second force vector being different.

The abdominal training apparatus may also include one or more intermediary pulleys. The intermediary pulleys may be configured to prevent the cable from rubbing against a portion of the abdominal training apparatus by guiding the cable past the portion. To properly store the cable, a cable support configured to support the second end of the cable may be included. The cable support may extend upward from the frame between the seat support and the resistance device.

In another embodiment, the abdominal training apparatus may comprise a frame having a front end and a back end, and configured to support one or more components of the abdominal training apparatus. A leg support comprising a foot rest and a leg rest may be located at the front end of the frame. The foot rest may be configured to support one or more feet of a user, while the leg rest may be configured to support an upper portion of one or more legs of the user. In this manner, the foot rest can be positioned below the leg rest to support the one or more legs in a bent position. The leg rest may positioned at one or more of the user's knees if desired. In addition, one or more foot retention devices may be provided to secure the one or more feet on the foot rest.

A resistance device configured to provide a resistance to a user may be provided at the back end of the frame. A cable may be attached at a first end to the resistance device. In general, the cable is configured to transfer the resistance from the resistance device to the user at one or more force vectors. The cable may include various harnesses attached to a second end of the cable. For example, the harness may comprise a plurality of shoulder straps configured to be grasped by the user to engage the cable for abdominal training.

The training apparatus may also include a seat support adjacent the leg support and comprising a substantially horizontal seat and an angled backrest. The seat support may be elevated above the frame by one or more risers. The backrest angled toward the seat, and the seat may be at substantially the same elevation as the leg rest.

Similar to the above, one or more pulleys configured to guide the cable from the resistance device to the user may be included. At least one of the one or more pulleys may be located at the back end of the frame and below the backrest to provide a force vector below and away from the user during abdominal training.

The pulleys may be positioned at various locations, as described herein. For example, a first pulley and a second pulley of the one or more pulleys may be below the seat support. The second pulley being lower and further away from the first pulley such that use of the first pulley provides the resistance to the user at a first force vector below and away from the user and use of the second pulley provides the resistance to the user at a second force vector below and away from the user. This is advantageous in that the first force vector and second force vector provided to the user are different.

A method for abdominal training is also disclosed herein. In one embodiment the method is performed on an abdominal training apparatus and includes the user sitting on a seat portion of an elevated seat support, placing one or more feet on a foot rest such that an upper portion of one or more legs are supported by a leg rest. The leg rest may be at substantially the same elevation as the seat support. The user may then secure the user's feet on the foot rest with one or more foot retention devices.

In preparation for abdominal training, the user may recline an upper body onto a backrest portion of the elevated seat support, and engage a first end of a cable of the abdominal training apparatus. The cable may be attached at a second end to a resistance device, and may be guided by one or more pulleys to provide a force having a force vector below and away from the upper body.

The user may lift or raise the user's upper body with one or more abdominal muscles while engaged to the cable. In this manner, lifting the upper body overcomes the force provided by the resistance device. It is noted that the force continues to have the force vector below and away from the upper body during lifting. The user may also lower the user's upper body while engaged to the cable. In this manner, the one or more abdominal muscles resist the force provided by the resistance device. It is noted that this force continues to have the force vector below and away from the upper body.

The cable may be engaged in a variety of ways. For example, engaging the first end of the cable may include grasping one or more shoulder straps of a harness attached to the first end of the cable. Also, the one or more shoulder straps may be held adjacent the upper body. To store the cable, it is noted that the first end of the cable may be hung on a cable support.

The user may adjust the force vector provided as well. For example, the force vector may be adjusted by moving the cable from a first pulley of the one or more pulleys to a second pulley of the one or more pulleys, where the first and second pulleys at different positioned below and away from the seat support. The force vector may also or alternatively adjusted by repositioning the seat support on an adjustable riser. It is noted that other elements of the training apparatus may be adjusted as well. For example, the amount of force provided by the resistance device may be adjusted in some embodiments.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The abdominal training apparatus provides improved support and focused resistance to a user utilizing the apparatus to train his or her abdominal muscles. In general, the user is supported or positioned by the apparatus such that the resistance provided by the apparatus is focused on the abdominal muscles. In addition, the resistance provided is not tied to a rigid structure and thus automatically adjusts to provide focused resistance to the abdominal muscles as the user's body moves during training. Furthermore, in this manner, the apparatus may be used by a variety of users of various sizes and shapes.

The abdominal training apparatus will now be described with respect to FIG. 1. In one or more embodiments, the training apparatus may comprise a support assembly 108 and a resistance assembly 112. In general, the support assembly 108 supports the user during training. The support assembly 108 may also include elements which help ensure proper positioning of the user during training. In general, the resistance assembly 112 provides a resistance against the movement of the user's body. Typically, the resistance will be focused on the user's abdominal muscles such that the force necessary to move or overcome the resistance is provided by the user's abdominal muscles.

Figure 1:
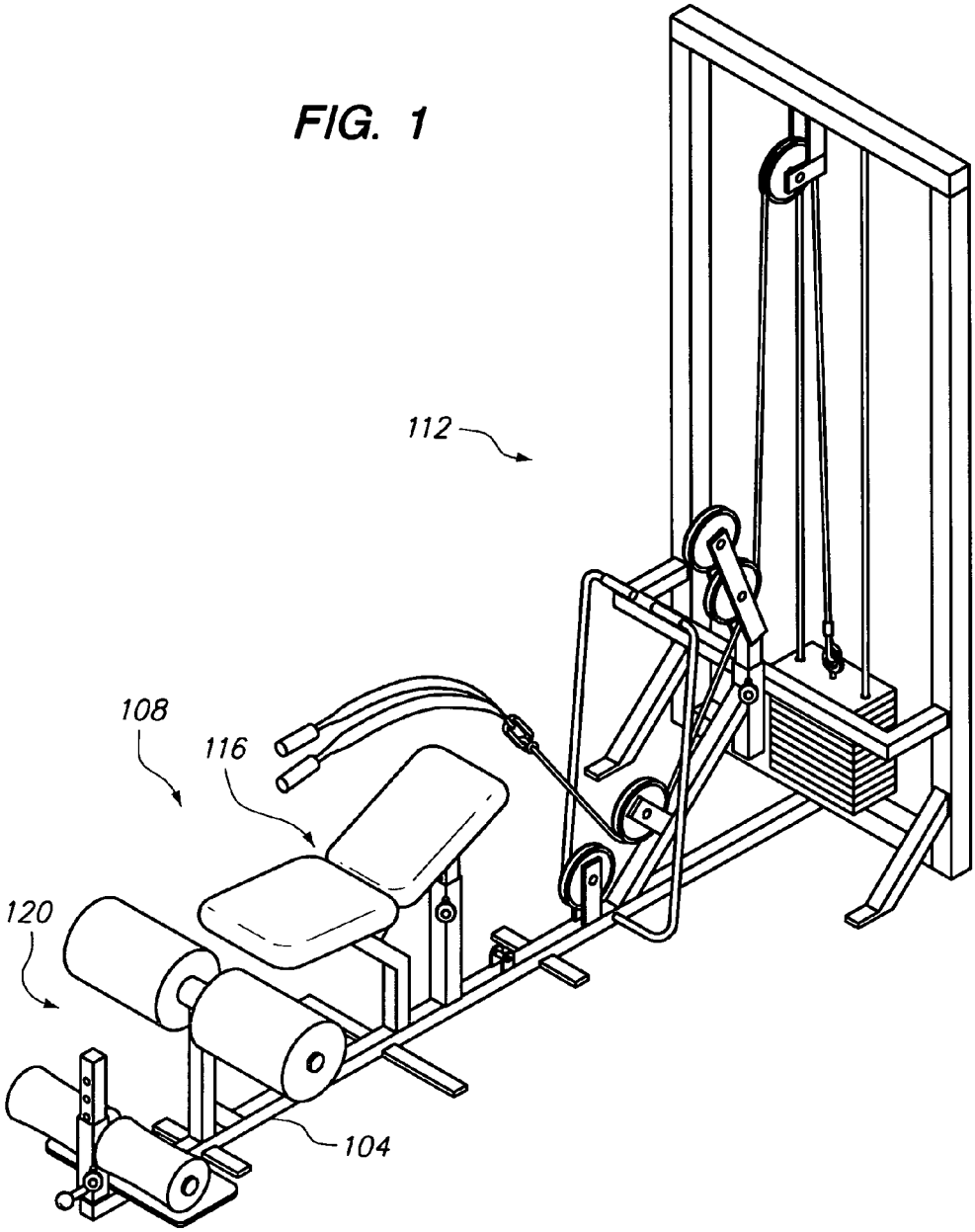
FIG. 1 is a perspective view of an exemplary abdominal training apparatus.

The support assembly 108 and resistance assembly 112 may be connected by a frame 104, such as shown in FIG. 1. The frame 104 may be a structure to which the support assembly 108 and resistance assembly 112 may be attached. In one or more embodiments, the frame 104 supports the assemblies 108,112. In addition, the frame 104 may be used to stabilize the training apparatus. For example, the frame 104 may be secured to a floor or other surface or have one or more stabilizers such as one or more legs or other members which prevent the training apparatus from tipping or moving during exercise.

As shown in FIG. 1, the frame 104 is a continuous structure which connects the support assembly 108 and the resistance assembly 112. It is noted that the frame 104 may comprise one or more sections that may be attached together or may be separate unconnected sections in various embodiments of the invention. For instance, a frame having two or more unconnected sections that respectively support the support assembly 108 and the resistance assembly 112 may be used. Separate frame sections can be beneficial in setting up or moving the training apparatus, especially in smaller locations.

The support assembly will now be described with regard to FIG. 2. As stated the support assembly 108 provides support for a user exercising on the training apparatus. Typically, the support assembly 108 will provide support for the user such that the user is positioned to maximize the efficiency of the abdominal exercises he or she performs on the training apparatus. In one or more embodiments, this may include locking in or securing a portion of the user's body, such as for example the user's legs, to focus training on the user's abdominal muscles.

Figure 2:
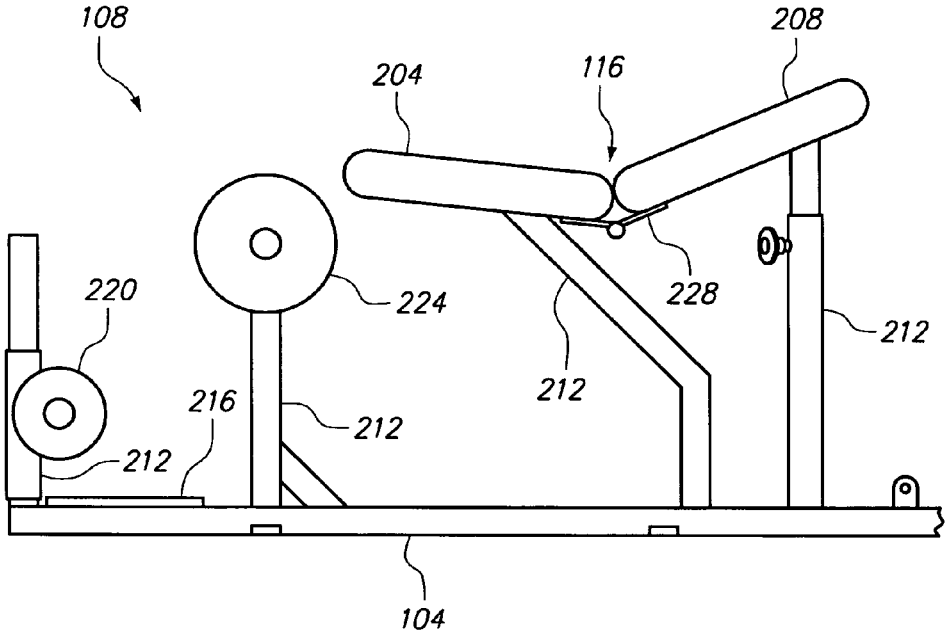
FIG. 2 is a side view of an exemplary support assembly.

As can be seen in FIG. 2, the support assembly 108 may comprise a seat support 116 which supports the user's upper body and a leg support 120 which supports one or more of the user's legs. In one or more embodiments, the leg support 120 and seat support 116 may be oriented such that the user's back is towards the resistance assembly of the training apparatus partially downward or both. For example, the leg support 120 may be at the front of the training apparatus and the resistance assembly may be at the back of the training apparatus, with the seat support 116 in between.

The seat support 116 may be configured in a variety of ways. In general, the seat support 116 will be configured to support a user in a lying or reclining position with the user facing upward. As will be described further below, an abdominal exercise starting from this position helps focus training onto the abdominal muscles. In the embodiment of FIG. 2, the seat support 116 comprises a seat 204 and a backrest 208. The seat 204, backrest 208, or both may be slightly angled towards one another. This allows the seat 204 and backrest 208 to support the user in a reclined position. To illustrate, the seat 204 may support the user's posterior while the backrest 208 supports the user's back. Because the seat 204 and backrest 208 are substantially or partially horizontal, the user is supported in a reclined position. In the embodiment shown, the seat 204 is horizontal while the backrest 208 is slightly angled towards the seat. The slight angle is beneficial in that it helps ensure the user does not over extend, thus reducing the risk of injury and increasing user comfort. Of course, the seat 204, backrest 208, or both may be oriented in various ways.

It is contemplated that the seat 204 and backrest 208 may be connected by one or more structures in some embodiments, though this is not required in all embodiments. For example, as shown in FIG. 2, the seat 204 and backrest 208 may be connected by a hinge 228. This allows the seat 204, backrest 208, or both to pivot or move relative to one another. In this manner, a variety of seat 204 and backrest 208 angles may be generated. In one embodiment, the backrest 208 may be supported by an adjustable riser 212 to allow the backrest to be repositioned at various angles via the hinge 228 and secured in a desired position. It will be understood that an adjustable riser 212 may be used in like manner to reposition the seat 204 in some embodiments.

Though shown as separate elements, it will be understood that the seat 204 and backrest 208 may be a single unit in one or more embodiments. Alternatively, only a seat 204 or only a backrest 208 may be provided in some embodiments. In addition, the seat 204, backrest 208, or both may be padded or unpadded.

The seat support 116 may also comprise one or more risers 212 that support the seat 204 and backrest 208 in an elevated position. The risers 212 may be rigid structures to perform this function and may secure the seat 204 and backrest 208 to the frame 104. As shown in FIG. 2 for example, the risers 212 hold the seat 204 and backrest 208 in an elevated position while securing the seat and backrest to the frame 104.

The elevated position of the seat 204 and backrest 208 is beneficial in that, in contrast to a sit up or crunch, it allows abdominal exercises to be performed off the floor. The elevated position also allows the user's legs to be secured and supported by the leg support 120 in a position that is comfortable for a variety of users. This is because the user's legs are supported or secured in a position like that of the user's legs when the user is sitting. The elevated position also allows the resistance provided by the resistance assembly 112 to be provided from below the user. This is highly beneficial in focusing training on the abdominal muscles, as will be described further below.

The leg support 120 may be configured in a variety of ways. In general, the leg support 120 supports the user's legs during abdominal exercises. It is noted that a user may elect to support his or her legs him or herself and that in these situations a leg support 120 need not be installed or provided. For example, as can be seen from FIG. 2, once a user is on the seat support 116 the majority of the user's weight may already be supported. Thus, the user may elect to support his or her legs without utilizing a leg support 120.

Though support of the user's legs may not be desired in all situations, a user may wish to secure his or her legs during abdominal exercise to enhance training. For example, by securing a user's legs in position during abdominal exercises, the user may be capable of moving increased resistance. To illustrate, the user's body weight may be too small to keep the user in position for some increased resistances. Thus, by securing his or her legs, the user is able to stay in position even when moving extreme resistance. For these reasons, the leg support 120 may provide support to a user's legs, secure a user's legs, or both in one or more embodiments.

As shown in FIG. 2, the leg support 120 comprises a foot rest 216 and a foot retention device 220. The foot rest 216 may be a platform or surface used to support a user's foot. To illustrate, the user may position or place his or her foot on the foot rest 216. It is contemplated that the foot rest 216 may be a structure or component of the training apparatus, or that the foot rest may be the ground or floor near the apparatus.

If desired, to secure the user's foot, a foot retention device 220 may be used to keep the user's foot in position during abdominal exercise. In FIG. 2 for example, a foot retention device 220 comprising a retention pad is provided at an elevated position over the foot rest 216. This allows the user to slip one or both feet between the retention pad and the foot rest 216 to wedge/secure his foot or feet therebetween. The foot retention device 220 may be supported, attached to the frame 104, or both by a riser 212 in one or more embodiments.

A foot retention device 220 may be a variety of structures or devices capable of securing one or more of the user's feet. For example, the foot retention device 220 may be one or more straps used to tie down the user's foot or feet. The foot retention device 220 could also be one or more shoe-like structures that accept a user's foot. It will be understood that a foot retention device 220, foot rest 216, or both may not be provided in all embodiments, such as described above. It is contemplated that the foot retention device 220 may include a foot rest in some embodiments and that, in these embodiments, a separate foot rest may not be provided.

In one or more embodiments, the leg support 120 may comprise a leg rest 224, though a leg rest is not required in all embodiments. In general, the leg rest 224 provides support to a portion of one or both of the user's legs above the ankle. This further stabilizes the user during abdominal exercise. For example, by supporting the user's legs, at least some lateral motion of the user's legs may be eliminated as the user performs abdominal exercises.

The leg rest 224 may be positioned at the user's knees in one or more embodiments. For example, the leg rest 224 may be positioned beneath the user's legs at the knee. Positioning the leg rest 224 at the knee is comfortable for the user and allows the user to use the leg rest as a leverage point to secure his or her feet in the retention device 220 or during exercise. Of course, the leg rest 224 may also be positioned at other locations. For example, the leg rest 224 may be beneath the user's thighs to support the upper portion of the user's legs. One or more risers 212 may be used to position the leg rest 224 in this manner. In addition, the leg rest 224 may be padded or unpadded in various embodiments.

The resistance assembly will now be described with regard to FIG. 3. As stated the resistance assembly 112 provides a resistance to the user's abdominal muscles to thereby tone and strengthen the abdominal muscles. The resistance provided will typically be directed such that the resistance is applied to the motion of the user's upper body. For example, the resistance may be directed such that it resists motion of the user's upper body when the user bends at the waist or abdominal area. Because the abdominal muscles generate or "power" this type of upper body motion, the force of the resistance is applied to the abdominal muscles.

The resistance assembly 112 may be configured in a variety of ways. In one or more embodiments, the resistance assembly 112 may be configured such that the resistance provided has a force vector below and away from the user. This, as will be discussed further below, enhances abdominal muscle training.

In one or more embodiments, the resistance may be provided through a cable 304 connected to a resistance device 308 which provides the force that makes up the resistance. For instance, as shown in FIG. 3, the resistance device 308 may be a weight stack 324 which moves along a track 320. The weight stack 324 provides resistance through gravity which generates a downward force vector at the weight stack. The weight stack 324 may be connected to a cable 304 which transfers the force or resistance of the weight stack to a user. As can be seen, the cable 304 may be guided or positioned to alter the downward or other force vector(s) generated by the resistance device 308.

Figure 3:
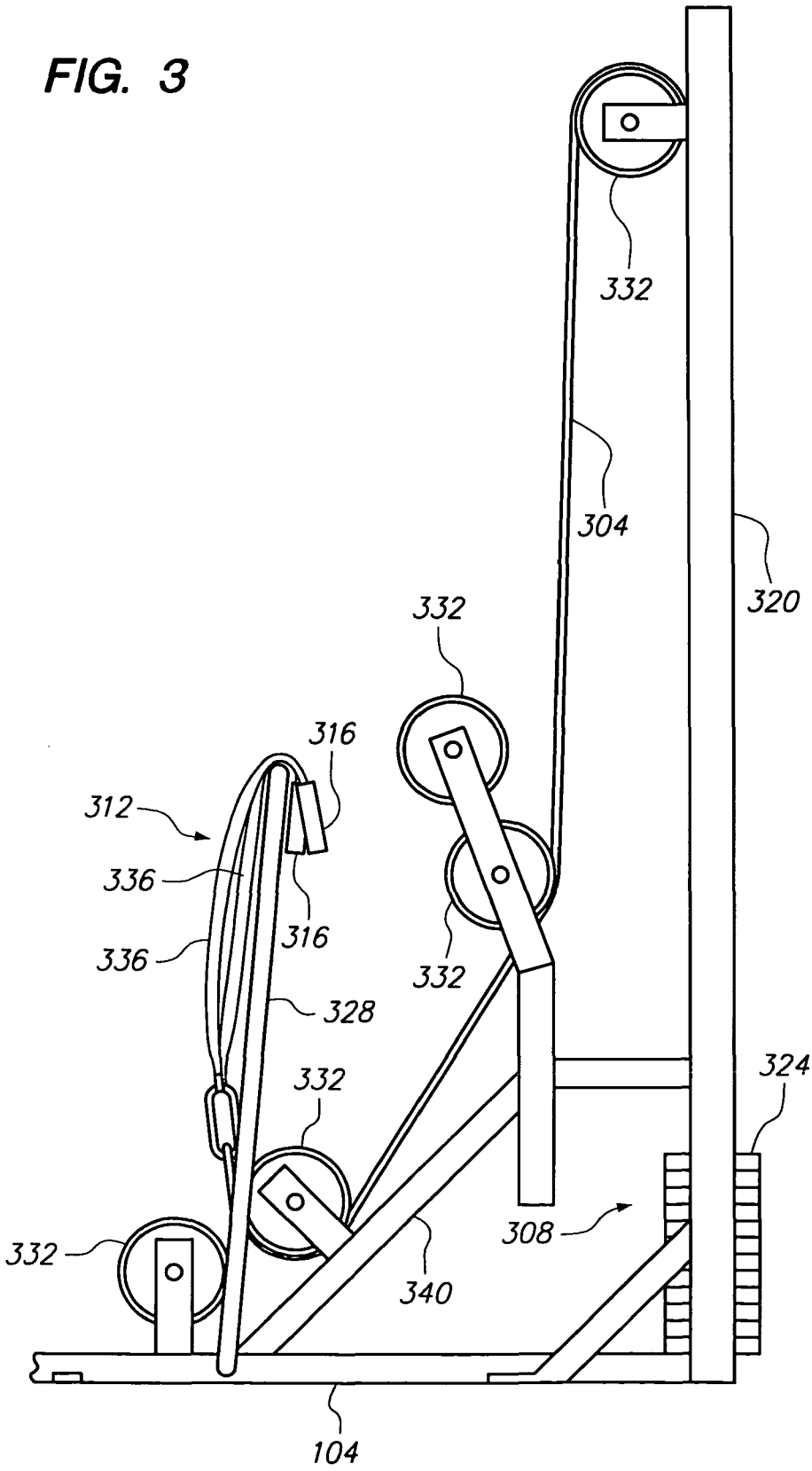
FIG. 3 is a side view of an exemplary resistance assembly.

In the embodiment of FIG. 3, one or more pulleys 332 guide the cable 304 such that the force vector provided by the resistance device 308 is below and away from the user. This can be seen by the leftmost pulley 332 which is positioned below and away from the seat support of the training apparatus. The embodiment shown, utilizes three pulleys 332 to transfer the force from the resistance device 308 to the user. Of course, other embodiments may utilize more or fewer pulleys. The pulleys 332 may be supported by a pulley support 340, the frame 104, or both, such as illustrated in FIG. 3.

It is noted that pulleys 332 may not be required in all embodiments. For example, the resistance device 308 may be configured to provide a force vector below and away from the user without the need for pulleys 332. Alternatively, other structures may be used in lieu of pulleys 332. For example, one or more low friction guides may be used to guide a cable 304 as desired.

It will be understood that a variety of resistance devices 308 may be used with the training apparatus. For example, one or more elastic bands, springs, flexible shafts, or hydraulics or the like may be used to provide a variable resistance. Other devices may be used to provide fixed resistance. In general, any resilient device or structure capable of exerting a force may be used as a resistance device. It is contemplated that the resistance device 308, regardless of type, may be connected to a cable 304 to adjust its force vector such that it is below and away from the user.

To move the resistance provided by the resistance device 308, the user may engage the cable 304 and apply a force, through his or her abdominal muscles, to the resistance device via the cable. Though the user may engage the cable 304 directly such as by grasping the cable, it is contemplated that a harness 312 may be provided in one or more embodiments to allow the user to more easily or conveniently engage the cable. In one or more embodiments, the harness 312 also ensures that the user is properly engaged to the cable thus maximizing the benefits of training on the training apparatus.

In general, the harness 312 comprises a structure or device which holds an end of the cable 304 in position relative to the user. For example, as shown in FIG. 3, the harness may comprise one or more shoulder straps 336 that the user may place over his or her shoulders and hold in place by grasping the straps. The shoulder straps 336 may include one or more handles 316 so that the straps may be more easily grasped and held in place. Use of the shoulder straps 336 will be described further below with regard to the operation of the training apparatus.

As can be seen, the shoulder straps 336 may be configured in a "V" shape. This helps ensure the shoulder straps 336 and the cable 304 are properly positioned relative to the user for training purposes. For instance, the apex of the "V" shape may be positioned near or at the back of the user's neck thus ensuring that the force vector from the resistance device 308 is applied properly to the user's upper body or upper back where it is most beneficial to abdominal training.

Of course, various harnesses 312 may be used with the training apparatus. For example, a harness 312 may be a rigid or semi-rigid structure which is placed over the user's shoulders. In another example, the harness may comprise a plurality of straps which lock, such as by one or more clips, zippers, hook and loop fasteners, hooks, ties, or the like, around a portion of the user's upper body or torso. In yet another example, the harness 312 may be a circular or other continuous shape configured to be placed around the user's torso or arms. In will be understood that harnesses 312 which lock or secure themselves to a portion of the user's body may not require the user to grasp the harness during training.

In one or more embodiments, a cable support 328 may be provided to store or support the cable 304 for convenient access. Proper storage of the cable 304 prevents the cable 304 from becoming damaged and reduces the risk of injury due caused by tripping or falling over the cable. In addition, storage of the cable 304 keeps the cable from becoming tangled.

The cable support 328 may be configured in a variety of ways. In one embodiment, the cable support 328 comprises one or more arms which hold the cable 304 at an elevated position. This is beneficial in that it allows a user, who is elevated by the seat support of the training apparatus, to easily access the cable 304 and/or harness 312 of the cable. This is especially so given that the user will typically be in a reclined or lying position and may find it difficult to reach the cable 304 otherwise.

The cable support 328 may comprise a cross bar which allows the cable 304 or harness 312 to be placed or hung thereon. It will be understood that various other structures may be used as well. For example, one or more clips, clamps, pockets, sleeves, or the like may be used to store the cable 304 or harness 312.

Figure 4A:
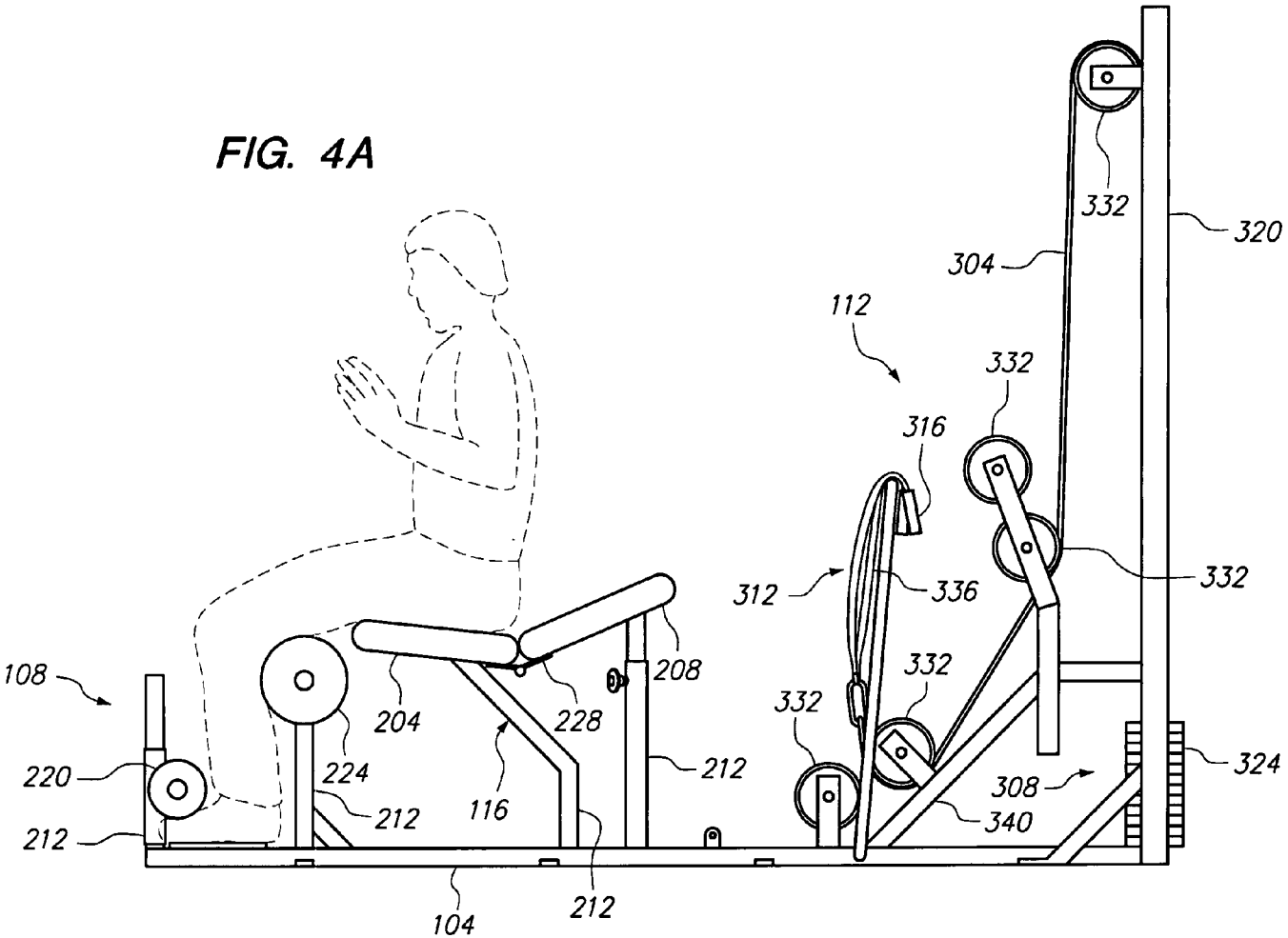
FIGS. 4A-4D illustrate an exemplary abdominal training apparatus in use.

Operation of the training apparatus will now be described with regard to FIGS. 4A-4D. FIG. 4A illustrates a user seated on the training apparatus in preparation for abdominal training. As can be seen, the user may sit on the seat support 116 facing toward the leg support 120. In this position, the resistance assembly 112 is behind the user.

Optionally, the user may lock in one or both of his or her legs. As shown in FIG. 4A for example, the user has locked in his legs. This may be accomplished in a variety of ways. In the embodiment shown, the upper portion of the user's legs may be positioned over a leg rest 224. The user may then wedge his feet between the foot rest 216 and the foot retention device 220 thereby locking his or her legs in place. Of course, the user may lock his or her legs in place in various ways depending on the configuration of the leg support 120, foot retention device 220, or both. For example, with a foot retention device 220 comprising one or more straps, the user may strap in his or her feet, legs, or both.

Figure 4B:
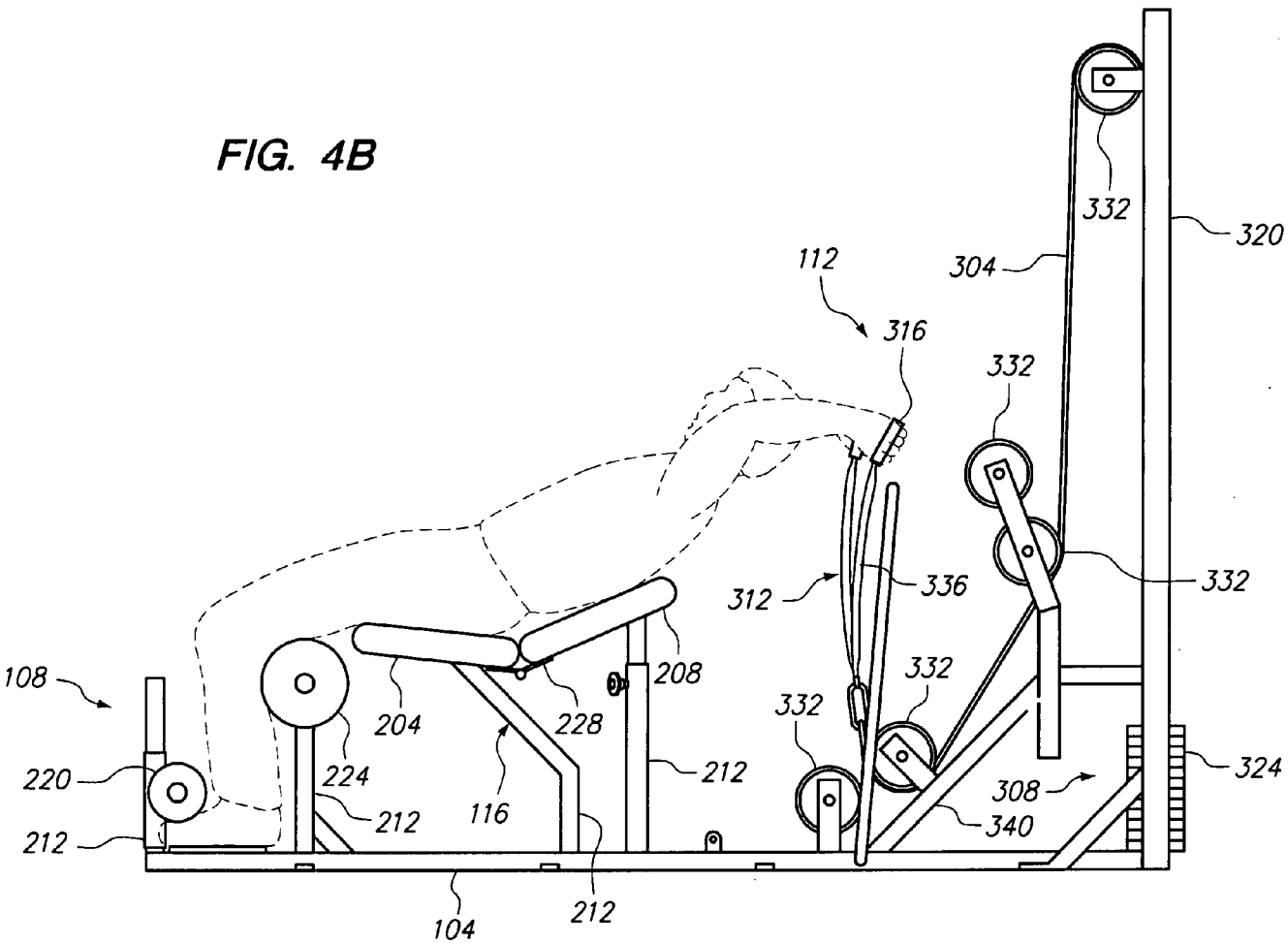

The user may then recline to position him or herself for abdominal training on the training apparatus, such as shown in FIG. 4B. In one or more embodiments, the user may recline until the user's back contacts or is supported by the seat support 116 or a portion thereof. For example, the user may recline such that his or her back is supported by the backrest 208. As stated, the seat support 116 or a portion thereof, such as the backrest 208, may be angled upward. In this manner, the user is supported such that the user is slightly bent at the waist. This is typically more comfortable for the user than lying flat. In addition, strain on the user's back is reduced by a reclined instead of a flat position. Of course, the seat support 116 may be flat in some embodiments, and the user may lie flat on his or her back in positioning him or herself for abdominal training. As can be seen, the user is supported such that the user's upper body is elevated. This allows the force vector from the resistance of the resistance assembly 112 to be directed below and away from the user, such as in the direction of the cable.

Figure 4C:
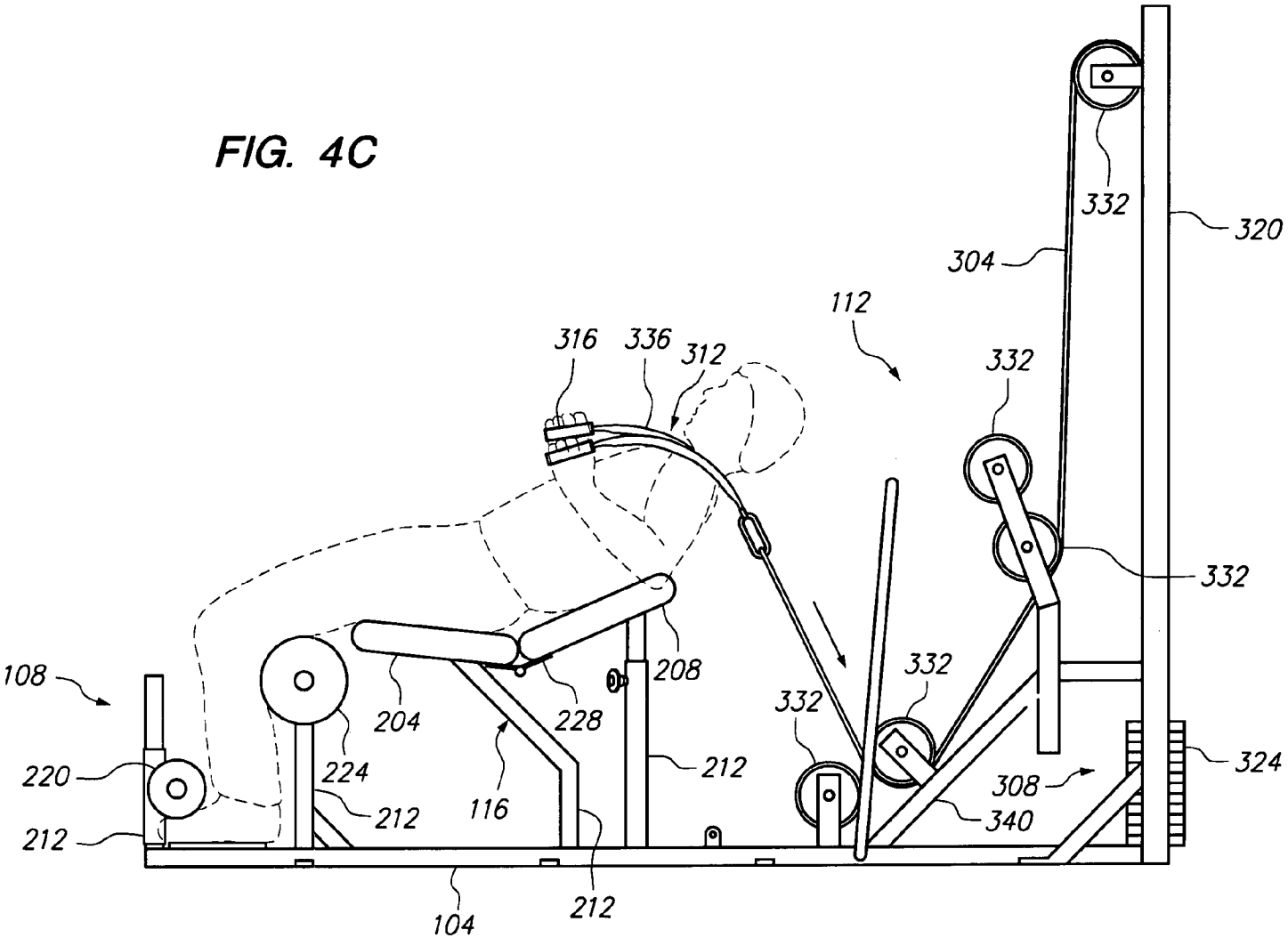

Once positioned, the user may engage the cable 304 such as shown in FIG. 4C. In the embodiment of FIG. 4C, the cable 304 includes a harness 312 having two straps 336 with handles 316. Thus, as shown, the user has engaged the cable 304 by grasping the handles 316 and pulling the straps 336 of the harness 312 over the user's shoulders. The user may grasp or hold onto the handles 316 in various ways. Typically, the user will hold the handles 316 such that his or her arms remain close to his or her body. In this manner, the user may utilize his or her body and hands to help hold the harness 312 in position during training. This is beneficial in that it makes it easier to hold the harness 312 in position. In addition, it is noted that by bending the harness 312 over the user's shoulders the amount of force required to hold the harness in position is reduced because most of the force provided by the resistance assembly 112 will be distributed across the user's shoulders or upper torso. Moreover, in this position, the resistance may be applied to the user while the user is in the reclined position. In this manner, the user experiences the resistance as soon as the user begins lifting his or her torso.

As shown, the user is holding the straps 336 of the harness 312 near the center of the user's chest. In this manner, the user's arms are folded on the user's chest in a relaxed position. This allows the user to hold the harness 312 in position and reduces the ability of the user to apply force through his or her arms. In this manner, the resistance provided by the resistance assembly 112 can be focused on the user's abdominal muscles rather than the user's arm muscles. This is beneficial because the user's arms are less likely to become fatigued and thus abdominal training may continue for long periods of time. In other words, the user does not have to interrupt abdominal training to rest his or her arms or other body parts.

As stated, the harness 312 may have various configurations. It will be understood that in embodiments where the harness 312 can be secured to the user, the user may not be required to hold or grasp the harness 312 to perform abdominal training. In addition, the user may directly engage the cable 304, such as by grasping the cable, in embodiments where a harness 312 is not provided. In one or more embodiments, the harness 312 may be configured to be engaged by or secured to a user such that there is little slack on the harness 312 and or cable 304. In this manner, the user may encounter the resistance as soon as (or even before) the user lifts his or her body from a reclined position rather than at some point after.

The arrow illustrated in FIG. 4C adjacent the cable 304 represents the force vector of the resistance provided by the resistance assembly 112 to the user via the cable. As can be seen, once the user has engaged the cable 304, such as by grasping the harness 312, the force vector of the resistance is directed below and away from the user. This may be accomplished by positioning a pulley 332 below and away from the user, such as shown in FIG. 4C.

In the embodiment of FIG. 4C, the pulley 332 is below and to the right of the user's shoulders or torso. This allows a force vector that is directed below and away from the user's shoulders or torso. In other words, the force vector is downward and away from the user in a diagonal orientation. Of course, the force vector may be directed in various other directions depending on the pulley locations. For example, the force vector may be less diagonal and more vertical, or the force vector may be more diagonal and thus point further away from the user. Adjustment of the force vector may be accomplished in a variety of ways. In one or more embodiments, the resistance assembly 112 may be adjusted or oriented to provide the desired force vector. In the embodiment shown for example, the pulley 332 adjacent the user may be moved to adjust the direction of the force vector. It is contemplated that the seat support 116 may alternatively or also be moved to adjust the force vector in some embodiments.

Figure 4D:
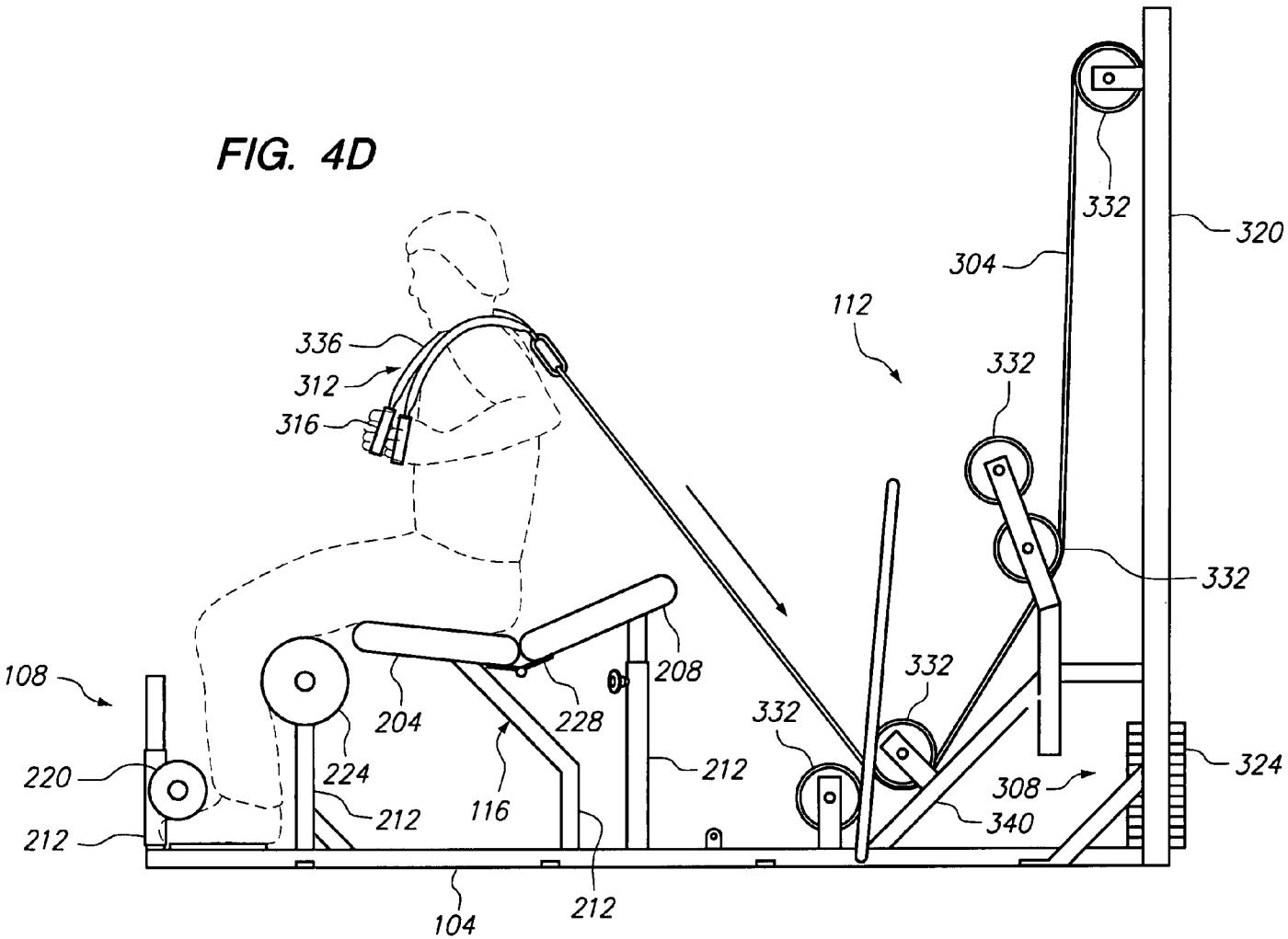

Once the cable 304 has been engaged, the user may begin abdominal training such as illustrated in FIG. 4D. In general, abdominal training on the training apparatus comprises lifting/raising and lowering the user's upper body with the abdominal muscles. This may be repeated one or more times as desired. In embodiments where the user holds the harness 312 or cable 304, abdominal training may also comprise holding on to or grasping the harness, cable or both to ensure that the user remains engaged to the resistance device during training. As discussed above, the user may hold or grasp a harness 312 or cable 304 such that the user's arms remain adjacent the user's chest or torso. This reduces the effort required to secure the cable 304 to the user and thus allows training to be focused on the abdominal muscles. In one embodiment, the user holds a harness 312 by its handles 316 with his or her arms folded onto his or her chest or torso, such as shown in FIG. 4C.

In one or more embodiments, the user may keep his or her arms in the same or substantially the same position during abdominal training. As shown in FIG. 4D for instance, the user's arms have not changed position from FIG. 4C. This helps ensure that the cable 304 remains stays in the same position relative to the user. As described above, the harness 312 helps ensure that the cable 304 is properly positioned relative to the user, such as at the user's upper back. In this manner, a force vector below and away from the user's upper back can be provided to the user.

As illustrated by FIG. 4D, the user may lift his or her upper body at the waist or abdominal area to perform abdominal training. In this manner, the user bends and the waist or abdominal area causing his or her upper body to raise up above the seat support 116. In executing this motion, the user must overcome the resistance provided by the resistance assembly 112 through the cable 304. Because the user is positioned in a reclined (or similar) position by the training apparatus, the lifting motion is powered substantially, if not completely, by the user's abdominal muscles. This focuses training on the abdominal muscles which tones and strengthens the abdominal muscles.

As stated, the user is also elevated by the seat support 116 when using the training apparatus. This allows a force vector below and away from the user which is highly advantageous for abdominal training. As can be seen in FIGS. 4C-4D, the force vector (as illustrated by the arrow adjacent the cable 304) remains oriented below and away from the user as the user lifts his or her upper body. In fact, the angle of the force vector relative to the user changes little, if any. This allows the resistance from the resistance assembly 112 to be applied to the user consistently across the user's range of motion.

In this manner, the force provided by the resistance assembly 112 remains substantially constant on the user's abdominal muscles as the user moves during training. This is an improvement over the prior art. Thus, the user experiences "complete" training of the abdominal muscles. To illustrate, the abdominal muscles which lift the upper body differ as the user lifts his or her upper body. Because the force vector and force of resistance is substantially constant relative to the user, all the user's abdominal muscles individually experience similar training on the training apparatus. This allows toning and strengthening results to be obtained across individual muscles of the user's abdominals, even those muscles that would otherwise be difficult to tone and strengthen.

It is noted that the force vector(s) provided by the training apparatus allow "complete" training of abdominal muscles without repositioning the user and without requiring the user to know or perform complex exercise techniques. As can be seen from FIGS. 4C-4D, the user can experience "complete" training on the training apparatus, by a lifting motion while engaged to the resistance device 112.

In FIG. 4D, the user has reached a raised position where the user has overcome the resistance of the resistance assembly 112. As can be seen, the weight stack 324, or a portion thereof has been lifted as a result. Once in this position, the user may continue training by lowering his or her upper body back towards the seat support 116. The user's abdominal muscles continue to be used during the lowering motion and thus continue to be toned and strengthened. This is because, in lowering his or her upper body, the user must resist the force provided by the resistance assembly 112 along the force vector. As stated above, the user has been positioned by the training apparatus such that this force is applied or focused on the user's abdominal muscles. Thus, the user utilizes his or her abdominal muscles during the lowering motion, further toning and strengthening the muscles.

As can be seen, the force vector remains substantially constant, if not the same, relative to the user as the user lowers his or her upper body. In this manner, like the user's previous lifting motion, the individual abdominal muscles experience substantially the same resistance as he or she lowers his or her upper body. The user thus experiences "complete" abdominal training in both lifting and lowering his or her upper body.

In FIG. 4C, the user is in a lowered position. In general, the user's back may be in contact with the seat support 116 or supported by the seat support 116 in this position. It is contemplated that the user may stop training and/or rest in this position. Alternatively, the user may continue abdominal training by performing one or more lifting/lowering repetitions while engaged to the cable 304.

As alluded to above, it may be optional for a user to lock or secure his or her legs during abdominal training. In FIGS. 4C-4D, it can be seen that the user has decided to lock the user's legs via the leg support 120. One benefit of locking in one or both legs, is that the user may train with additional weight or resistance. Locking in the user's legs keeps the user engaged to the seat support 116 thus allowing the user to train with stronger resistances that would otherwise lift or move the user off the seat support when the user's abdominal muscles apply force to such resistances. This allows the user to lift or move even substantial resistances or weights while remaining positioned on the seat support 116. As the user's abdominal muscles increase in strength, this capability allows the user to train with increasing resistances.

As shown, the resistance assembly 112 utilizes a weight stack 308 to provide resistance. Prior to training or during training, the user may adjust the resistance provided by adjusting the amount of weight is lifted by the cable 304. This may be accomplished by locking one or more weights 324 to the cable 304 to achieve the desired resistance.

As briefly described above, elements of the training apparatus may be adjusted in other ways as well. For example, various elements of the training apparatus may be repositioned or moved such as to accommodate different sized users or to improve ergonomics or comfort. Some elements may also be adjusted to reduce the risk of injury by preventing risky user motions or making risky user motions less likely to occur.

Figure 5A:
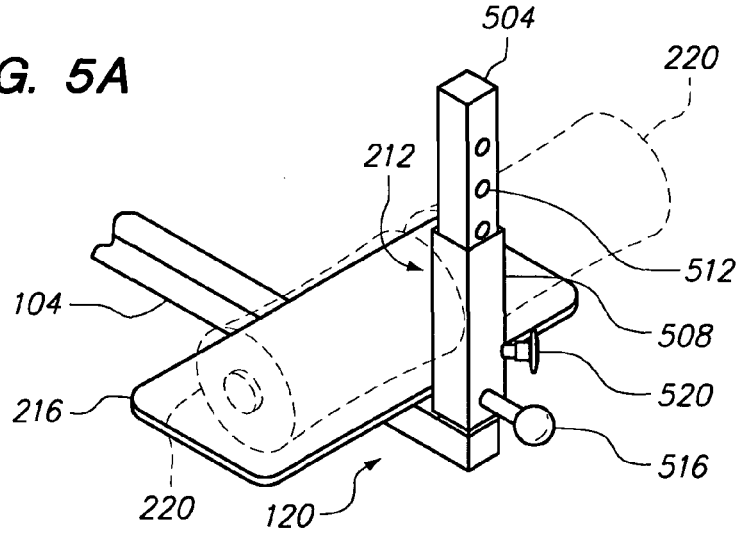
FIGS. 5A-5C illustrate adjustable elements of an exemplary abdominal training apparatus.

For instance, FIG. 5A illustrates an adjustable leg support 120. As can be seen, the foot retention device 220 may be moved up and down and secured in position by the adjustable leg support 120. This allows the leg support 120 to accommodate a user's feet and/or legs regardless of their size. In addition, users may adjust the foot retention device 220 (or other elements of the training apparatus) to improve comfort, ergonomics, or to suit the user's personal preferences.

In one embodiment, adjustability may be accomplished by a riser 212 that comprises a sleeve 508 and an adjustable member 504. The adjustable member 504 may be configured to fit into and slide within the sleeve 508. For example, the adjustable member 504 may have a size and shape which allows it to fit into the sleeve 508. This allows the sleeve 508 and adjustable member 504 to move relative to one another. Typically, the adjustable member 504 will fit snugly into the sleeve 508 to stabilize the adjustable member.

The adjustable member 504 may include one or more openings 512 which allow the sleeve 508 and adjustable member to be secured in position relative to one another once the desired position is achieved. For example, once the sleeve 508 is positioned as desired, a corresponding locking pin 516 of the sleeve 508 may be inserted into or through an opening 512 of the adjustable member 504 thus locking or securing the sleeve in place relative to the adjustable member. The locking pin 516 may be removed from the opening 512 to allow the adjustable member 504 to move or be adjusted once again. Because the foot retention device 220 is attached to the sleeve 508, securing the sleeve in position also secures the foot retention device in position.

The locking pin 516 may be spring loaded, such as shown in FIG. 5A or may be other configurations. For example, a removable pin comprising an elongated member may be inserted into one of the openings 512 in some embodiments. It is noted that a spring loaded locking pin 516 is beneficial in that it can remain connected to the sleeve 508 while it is being retracted from an opening 512. In addition, the spring of the spring loaded locking pin 516 would automatically move the locking pin into an opening 512 of the adjustable member, once the pin is released by a user.

A screw tension knob 520 of the sleeve 508 may also be provided in some embodiments, to further secure and/or stabilize the adjustable member. In one or more embodiments, the screw tension knob 520 may comprise a knob and a threaded portion. The knob may be used to turn the threaded portion in a threaded opening of the sleeve 508. As the threaded portion is turned it may be advanced toward the adjustable member 504 and tightened onto the adjustable member. This provides a clamping force which further secures the adjustable member. Of course, a screw tension knob 502 would not be required in all embodiments as the adjustable member may be suitably secured without one. The screw tension knob 502 may be released by turning its threaded portion such that the screw tension knob moves away from the adjustable member.

Figure 5B:
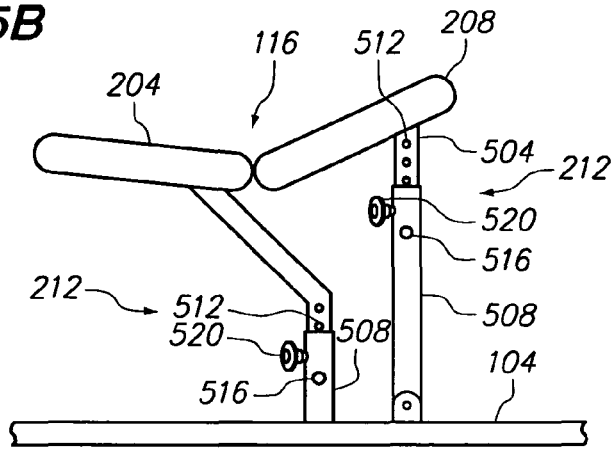

The adjustability provided by the sleeve 508 and adjustable member 504, as previously described, may be applied to other risers 212 or elements of the training apparatus to allow adjustability of the other risers or elements. For example, as shown in FIG. 5B, the seat support 116 is supported by risers 212 comprising respective sleeves 508 and adjustable members 504. As can be seen, this allows the seat 204, backrest 208, or both to be repositioned. As with above, the seat 204, backrest 208, or both may be adjusted up and down and secured into position by one or more locking pins 516 and openings 512, one or more screw tension knobs 502, or a combination thereof.

It is noted that adjustability of the riser 212 with regard to the seat support 116 occurs by moving the adjustment member 504 relative to the sleeve 508. This is in contrast to the above leg support 120, where the sleeve 508 may be moved relative to the adjustment member 504 to adjust the foot retention device. It will be understood that adjustability of the training apparatus' elements may occur in both ways.

Adjustability of the seat support 116 is beneficial in that it allows the user to adjust the amount the user reclines when using the training apparatus. For example, the user may lower a seat 204 of the seat support 116 to decrease the amount the user reclines when supported by the seat support 116. Alternatively, or in addition, the user may raise the backrest 208 to decrease the amount of recline. The user may also increase the amount the user reclines by raising the seat 204, lowering the backrest 208, or both. It is contemplated that, in one or more embodiments, the seat 204, backrest 208, or both may also or alternatively be supported on a swivel or pivot to allow adjustment of the amount a user reclines.

Adjustability of the seat support 116 also allows the user to adjust the orientation or angle of the force vector provided by the resistance assembly. This is because raising or lowering the seat support 116 would change the angle of the force vector. This is beneficial in that in some embodiments, the adjustment of the force vector provides a different resistance to the user. For example, the user may experience less resistance for one force vector and more resistance for another force vector.

In addition, to ergonomic and comfort benefits, adjustment of the amount a user reclines may reduce the risk of injury or prevent injuries. For example, decreasing the amount the user reclines may help ensure the user does not over extend causing injury. Alternatively, a decreased amount of recline may prevent the user from exacerbating a previous injury or ailment.

Figure 5C:
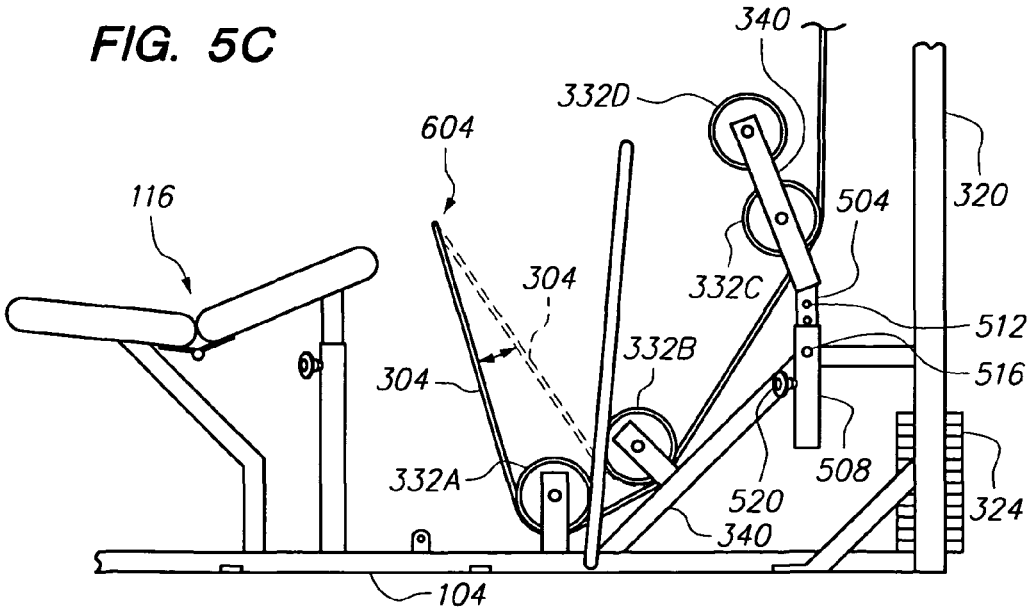

FIG. 5C illustrates the adjustability provided by the sleeve 508 and adjustable member 504 with regard to the pulley support 340. As can be seen, pulleys 332C and 332D may be adjusted or repositioned by the sleeve 508 and adjustable member 504 combination. As with above, the adjustable member 504 may be secured in a desired position by a locking pin 516, screw tension knob 520, or both. Adjustment of the position of one or more pulleys is beneficial in that it prevents the cable 304, which is guided by the pulleys, from contacting other elements of the training apparatus. For example, if a portion of the cable 304 is at too high or too low of an angle, it may rub against one or more portions of the training apparatus. This wears down the cable and may damage the surface of the training apparatus. In the embodiment of FIG. 5C, the pulleys 332C,332D may be adjusted through the sleeve 508 and adjustable member 504 to prevent such an occurrence.

Though illustrated as making pulleys 332C,332D adjustable, it will be understood that other pulleys may be made adjustable by a sleeve 508 and adjustable member 504. For example, pulley 332A, pulley 332B, or both could be made adjustable in this manner. This is advantageous in that it provides another way that the force vector provided to a user may be adjusted. Of course, the force vector may also be adjusted by utilizing various of the training apparatus' pulleys. For example, in FIG. 5C, switching from pulley 332A to pulley 332B or pulley 3320 provides a different force vector to the point where the cable 304 engages the user, as represented by point 604.

Though adjustability in one or more embodiments has been described herein with regard to a sleeve 508 and adjustable member 504, it will be understood that a variety of structures or devices may be used to provide adjustability of one or more elements of the training apparatus. For example, various elements of the training apparatus may be positioned as desired and subsequently screwed, clipped, clamped, or otherwise secured in position.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An abdominal training apparatus comprising:

a frame having a front and a back, the frame configured to support one or more elements of the abdominal training apparatus;

a resistance device at the back of the frame, the resistance device configured to provide a resistance for abdominal training;

a cable having a first end attached to the resistance device, the cable configured to transfer the resistance from the resistance device to the user;

a harness attached to a second end of the cable, the harness configured to be grasped by the user to engage the cable and resistance device for abdominal training;

a seat support at the front of the frame, the seat support elevated over the frame; and one or more pulleys configured to guide the cable from the resistance device to the user, at least one of the one or more pulleys located lower than the seat support to provide a force vector that is downward and away from the user during abdominal training, wherein a first pulley and a second pulley of the one or more pulleys is below the seat support, the second pulley being lower than the first pulley, whereby the first pulley creates a first force vector below and away from the user and the second pulley creates a second force vector below and away from the user, the first force vector and second force vector being different.

2. The abdominal training apparatus of claim 1, wherein the seat support comprises a seat and a backrest, the backrest angled upwards to support the user in a reclined position.

3. The abdominal training apparatus of claim 1, wherein the resistance device is a weight stack comprising one or more weights.

4. The abdominal training apparatus of claim 1 further comprising one or more intermediary pulleys, the one or more intermediary pulleys configured to prevent the cable from rubbing against a portion of the abdominal training apparatus by guiding the cable past the portion.

5. The abdominal training apparatus of claim 1 further comprising a cable support configured to support the second end of the cable, the cable support extending upward from the frame between the seat support and the resistance device.

* * * * *